US006951588B1

(12) United States Patent
Bernhard et al.

(10) Patent No.: US 6,951,588 B1
(45) Date of Patent: Oct. 4, 2005

(54) WHITE GOLD ALLOY COMPOSITIONS

(75) Inventors: Melvin Bernhard, Williamsville, NY (US); Ajit B. Menon, Lancaster, NY (US)

(73) Assignee: United Precious Metal Refining, Inc., Alden, NY (US)

( * ) Notice: Subject to any disclaimer, the term of this patent is extended or adjusted under 35 U.S.C. 154(b) by 47 days.

(21) Appl. No.: 10/800,904

(22) Filed: Mar. 15, 2004

(51) Int. Cl.[7] ..... C22C 5/00
(52) U.S. Cl. ..... 148/430; 420/511
(58) Field of Search ..... 420/511; 148/430

(56) References Cited

FOREIGN PATENT DOCUMENTS

| | | | |
|---|---|---|---|
| DE | 4320928 | * | 6/1993 |
| DE | 19958800 | * | 1/2001 |

* cited by examiner

*Primary Examiner*—Sikyin Ip
(74) *Attorney, Agent, or Firm*—Phillips Lytle LLP

(57) ABSTRACT

A nickel- and palladium-free 14-karat white gold alloy composition consists of the following parts by weight: about 58.34% gold, about 35–40% silver, about 0.5–1.80% tin, and about 0–0.75% germanium.

2 Claims, No Drawings

WHITE GOLD ALLOY COMPOSITIONS

TECHNICAL FIELD

This invention relates to novel white gold alloy compositions that exhibit the desirable properties of improved color and workability, but without the use of nickel, palladium or platinum.

BACKGROUND ART

Many white gold alloy compositions are known. Most are used in making jewelry. There is no standard or specification for the composition of white gold. Many white golds alloys contain nickel or palladium as the bleaching agent. Silver, the whitest of all elements, can be used as the bleaching agent. However, in alloys above 9 karat (i.e., 37.5% gold), silver causes the alloy color to become greenish. Green gold typically includes gold, a high amount of silver, and a small amount of copper.

When nickel is used as the main bleaching agent, the amount of nickel determines the whiteness of the gold. The main advantage of nickel is low cost. However, there are many disadvantages to the use of nickel. Nickel can cause an allergic reaction in approximately 5–10% of the population. If an individual becomes sensitized to nickel, it becomes a lifelong allergy, and skin reactions can be quite severe. Currently, many countries regulate the amount of nickel that can be used in white gold, or require that white gold be nickel-free.

In manufacturing of nickel white gold, there are many disadvantages. If high amounts of nickel (i.e., on the order of 15–30%) are used, the alloy becomes very hard. This makes it more difficult to work the metal, and causes increased stress on the worker. Also, the higher the nickel content, the higher the melting temperatures required. This can cause poor productivity in investment casting, due to gas porosity. Lower nickel content white golds (i.e., on the order of 5–12% Ni) allow for somewhat softer metal and lower melting temperatures, but are grayish in color and typically require a surface plating of rhodium to be commercially acceptable.

Rhodium plating is normally recommended on nickel white gold. Rhodium is a high-reflectivity platinum-group metal, which is extremely hard and corrosion-resistant.

There are no regulations regarding the amount of rhodium applied. Many manufactures use "flash plating"; that is, to apply an extremely thin coating. Such flash-type plating typically wears off with product usage, exposing the underlying white gold. The main reason for flash plating is cost, as rhodium is very expensive. Proper rhodium plating should never wear, due to its hardness. Rhodium should have to be stripped off and plated again when the product is serviced, such as changing a ring's size. The rhodium also provides a barrier between the skin and the nickel-containing white gold.

High nickel white golds generally do not require rhodium plating because of an acceptable white gold color. However, this exposes the skin to higher nickel contents. High-nickel white golds were the general standard in Europe for many years, whereas low-nickel white golds have been the prevalent choice in the United States. This may be why a higher amount of allergic reactions forced regulation in some European countries.

Nickel white gold also can cause a metallurgical problem known as stress corrosion cracking. Typically, many settings on jewelry rings are made from nickel white gold that is die struck from cold-rolled sheet. Stress corrosion cracking is caused by weak grain boundaries that occur in wrought product that is hard and under stress. This is usually seen as broken or cracked prongs on rings. The grain boundaries under stress are corroded easily by many chemicals, including those of a common household variety.

Nickel white golds are also poor in their ability to be reused. This causes a high amount of scrap, which needs to be refined and recycled with the associated costs.

When palladium is used as a bleaching agent for white gold, the amount of palladium in the alloy determines the whiteness of the gold. Typically, palladium alloys are grayish in color. Most palladium alloys still require a rhodium plate for acceptable appearance. The main advantages of palladium white gold are: (1) no known allergic reactions, and (2) relative softness, which allows the metal to be easily worked. However, there are some disadvantages to palladium white golds. Currently, the price of palladium (about $230 per Troy oz.) has caused the cost of materials to rise to such an extent that usage and sales have fallen significantly. The cost of the palladium white gold has at times approached or exceeded the price of platinum, which is regarded as a higher quality product. Palladium prices have dramatic price swings, which create difficulty in consistent pricing at both manufacturing and retail.

High palladium white golds have high melting temperatures, and, consequently, fast solidification times. This limits productivity by limiting the number of units producible by investment casting technique at one pour. Moreover, the high temperature can cause interaction when investment casting with typical investment materials. This causes a sulfur gas to react with the silver (normally high content in the palladium alloys) to form silver sulfide on the product surface, which is very hard to remove.

The cost of refining the palladium in the white gold scrap produced, is expensive, usually between 15% and 25% of the palladium cost.

When silver is used as a bleaching agent, it whitens the gold in 9 karat (i.e., 37.5% gold). In 10 karat, it shows a yellowish tint. In 14 karat, it produces a greenish tint. In 9 karat, the color is a brilliant white, with the silver dominating the color. Silver is the whitest and highest-reflectivity metal known. The higher karat white golds (i.e., 10–18 karat) which use silver must be rhodium plated. However, the plating must be thick to prevent the greenish tint from appearing if the rhodium wears off. The cost of the rhodium plating is also a drawback.

The advantages of silver-bleached white gold are relative softness, which allows easily workable metal, relatively low cost of raw material (about $5 per Troy oz.), low cost of refining and recycling, and absence of known allergic reactions. The disadvantages of silver are the poor color (greenish), and the tendency to tarnish.

DISCLOSURE OF THE INVENTION

The present invention provides an improved non-allergic nickel-free and moderate-cost palladium-free white gold alloy compositions that exhibit the desirable properties of excellent workability, good corrosion resistance (i.e., elimination of stress corrosion cracking), and a white color which can eliminate the need for rhodium plating.

The improved composition broadly consists of the following parts by weight for use in 14-karat white gold: a bout 58.34% gold, about 35–40% silver, about 0.5–1.80% tin, and about 0–0.75% germanium The percentages of silver, tin and germanium may vary.

One specific and preferred 14 karat white gold alloy composition consists of about 58.34% gold, about 39.66% silver, about 1.50% tin, and about 0.50% germanium. This composition is nickel-free (non-allergic) and palladium-free (moderate cost), and exhibits the desirable properties of excellent workability, good corrosion resistance (elimination of stress corrosion cracking), and a bright white color, which can possibly eliminate the need for rhodium plating.

Accordingly, the general object of this invention is to provide improved white gold alloy compositions.

Another object is to provide improved white gold alloy compositions that are non-allergic and nickel-free.

Another object is to provide improved white gold alloy compositions that are moderate in price and palladium-free.

Another object is to provide an improved white gold alloy composition, which has excellent workability, which increases productivity and reduces work stress.

Another object is to provide an improved white gold alloy composition, which has a bright white color and can be produced without the necessity to rhodium plate.

These and other objects and advantages will become apparent from the foregoing and ongoing written specification, and the appended claims.

MODE(S) OF CARRYING OUT THE INVENTION

As noted above, the present invention provides an improved white gold alloy composition. The improved compositions are deemed to have particular use as a replacement for present commercially-known and available white gold alloys. However these particular compositions are only illustrative. Hence, the invention should not be limited to a particular karat gold or a particular industry.

The invention broadly provides improved nickel-free (i.e., non-allergic), palladium-free (i.e., moderate in price) white gold alloy compositions, which are particularly suited to the jewelry industry, which exhibits the desirable properties of, has excellent workability properties, has good resistance to corrosion, and has a bright white color that does not require rhodium plating.

White gold alloys, by current standards usually contain gold, copper, zinc and either nickel or palladium to promote white color. Metals other than or in addition to these typical metals may be used in white gold alloys to enhance particular properties.

The invention broadly provides improved 14-karat white gold alloy compositions, which consist of the following parts by weight: about 58.34% gold, about 35–40% silver, about 0.5–1.80% tin, and about –0.75% germanium. In the foregoing composition, the combination of tin and/or germanium is used to bleach the normally greenish tint caused by the main elements of gold, silver and zinc. Silver is used to control workability in the alloy. Gold must, of course, be present in the necessary percentage to qualify as legal 14 karat gold.

These metals when alloyed in the ranges indicated, have been found to produce white gold that is nickel-free (i.e., non-allergic), palladium-free (i.e., reasonable cost), that has excellent workability properties, good corrosion properties, and can eliminate the need to rhodium-plate, with the additional advantages of not producing surface oxides when melted. The additional advantage of not producing surface oxides allows the white gold alloy to be reused or recycled much longer than currently existing white gold alloys. This allows cost savings through inventory control and recycling.

In one specific composition, the alloy was produced to have: about 58.34% gold, about 39.66% silver, about 1.50% tin, and about 0.50% germanium. The alloy was weighed and placed in a crucible for melting. When the mixture was molten, it was stirred and poured through a tundish into water, which solidified and shaped the granules in the form of shot. Quantities of such shot were then provided to a jewelry manufacturer for testing. The shot was measured, remelted and poured into investment castings to produce desired articles. The shot was also measured, remelted and poured into an ingot mold to produce an ingot which was subsequently cold-rolled (wrought) into a sheet for hand fabrication.

The investment cast articles produced clean castings, which were free from porosity when finished. Casting temperature was approximately 1800° F., which is more favorable than the 1900–2100° F. temperatures needed to cast current nickel- and palladium-containing white gold. Finishing was done using normal jewelry finishing compounds, finding the finishing slightly easier than current white gold. Stone setting was perform to test for hardness and memory (spring back) in the prongs. Effort and results were much better then current nickel white gold, as there was no memory and the prongs were easier to move. Bending a prong back and forth until it fractured tested the strength. It took four back and forth bends to break the prong. This is better then nickel white gold and comparable to yellow gold alloys. The finished product produced a bright white finish which was judged to be whiter and more reflective then either nickel or palladium white gold. No rhodium plating was necessary. The ingot was cold-rolled to test for ductility. The rolling showed a normal reduction in thickness before annealing (softening). It was comparable in hardness to normal yellow gold and as ductile as palladium which are much easier to work than nickel white gold.

Therefore, while a preferred form of the improved white gold alloy composition has been described, and certain modifications thereof discussed and suggested, persons skilled in this art will readily appreciate that various additional changes and modifications may be made without departing from the spirit of this invention, as defined and differentiated by the following claims.

What is claimed is:

1. A nickel- and palladium-free 14-karat white gold alloy composition, consisting of the following parts by weight: about 58.34% gold, about 35–40% silver, about 0.5–1.80% tin, and 0.1–0.75% germanium.

2. A nickel- and palladium-free 14-karat white gold alloy composition having excellent workability properties, good corrosion-resistance properties and a bright white color that can be produced without the necessity of being rhodium-plated, consisting of the following parts by weight: about 58.34% gold, about 39.66% silver, about 1.50% tin, and about 0.50% germanium.

* * * * *